United States Patent [19]

Bramstedt et al.

[11] Patent Number: 4,842,498

[45] Date of Patent: Jun. 27, 1989

[54] DIAPHRAGM COMPRESSOR

[75] Inventors: David Bramstedt, Sheboygan; Roy J. Rozek, Plymouth, both of Wis.

[73] Assignee: Thomas Industries, Inc., Sheboygan, Wis.

[21] Appl. No.: 187,318

[22] Filed: Apr. 28, 1988

Related U.S. Application Data

[63] Continuation of Ser. No. 4,899, Jan. 20, 1987, abandoned.

[51] Int. Cl.[4] ..... F04B 21/02; F04B 35/04; F04B 43/04

[52] U.S. Cl. ..... 417/571; 417/413; 417/DIG. 1; 604/153

[58] Field of Search ..... 417/471, 571, 413, DIG. 1; 604/152, 153

[56] References Cited

U.S. PATENT DOCUMENTS

| | | | |
|---|---|---|---|
| 3,039,399 | 6/1962 | Everett | 604/153 |
| 3,449,479 | 6/1969 | Rosenberg | 604/152 |
| 3,645,651 | 2/1972 | Bills | 417/479 |
| 3,684,406 | 8/1972 | Edwards | 417/454 |
| 3,771,911 | 11/1973 | Turci | 417/413 |
| 3,776,666 | 12/1973 | Ludwig | 417/411 |
| 3,831,548 | 8/1974 | Droege | 417/413 |
| 4,086,036 | 4/1978 | Hagen | 417/413 |
| 4,086,037 | 4/1978 | Stewart | 417/571 |
| 4,231,724 | 11/1980 | Hope | 417/472 |
| 4,236,880 | 12/1980 | Archibald | 417/478 |
| 4,411,603 | 10/1983 | Kell | 417/479 |
| 4,433,966 | 2/1984 | Krumm | 417/571 |
| 4,468,222 | 8/1984 | Lundquist | 604/153 |
| 4,515,591 | 5/1985 | Hemmerich | 604/152 |
| 4,519,792 | 5/1985 | Dawe | 604/152 |
| 4,536,139 | 8/1985 | Greco | 417/471 |
| 4,571,160 | 2/1986 | King | 417/413 |
| 4,573,883 | 3/1986 | Noon | 417/394 |
| 4,657,490 | 4/1987 | Abbott | 417/428 |

*Primary Examiner*—William L. Freeh

*Attorney, Agent, or Firm*—James G. Staples; David I. Roche

[57] ABSTRACT

A diaphragm compressor composed of non-metallic parts capable of being manufactured and assembled so inexpensively as to be suitable for one-time use. Conventional expensive fasteners such as screws are eliminated and assembled parts are joined by press fitting, sonic welding or similar inexpensive functionally similar means.

5 Claims, 2 Drawing Sheets

Fig. 1.
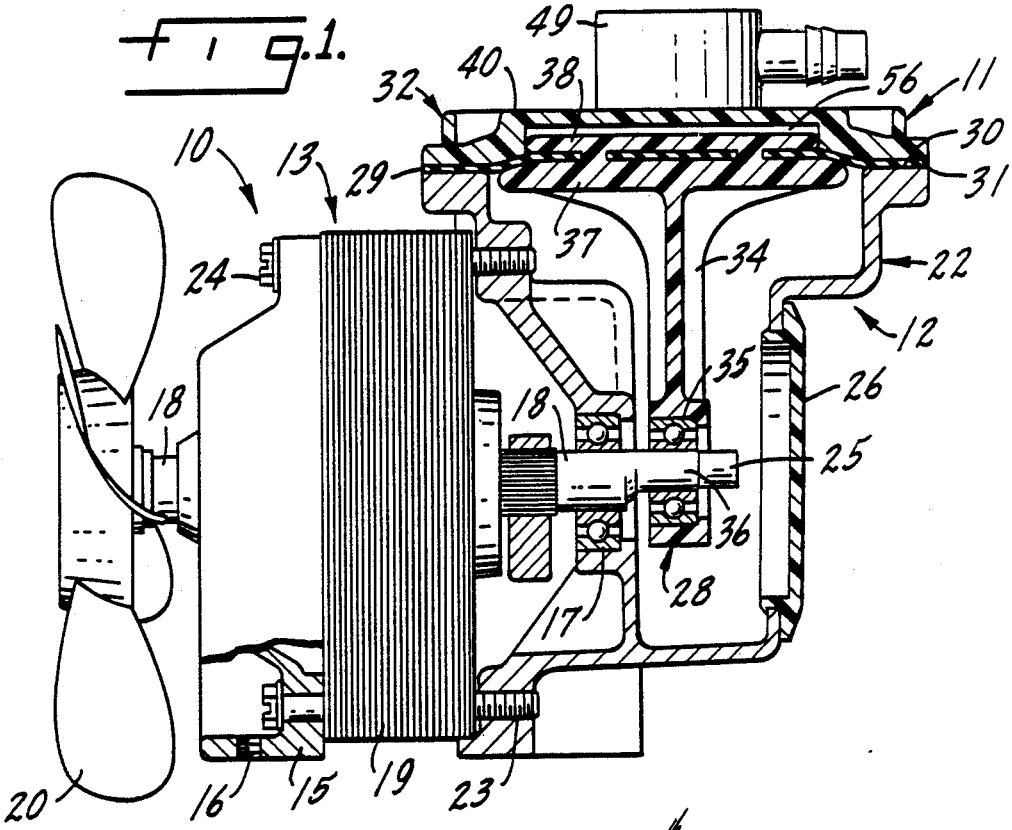
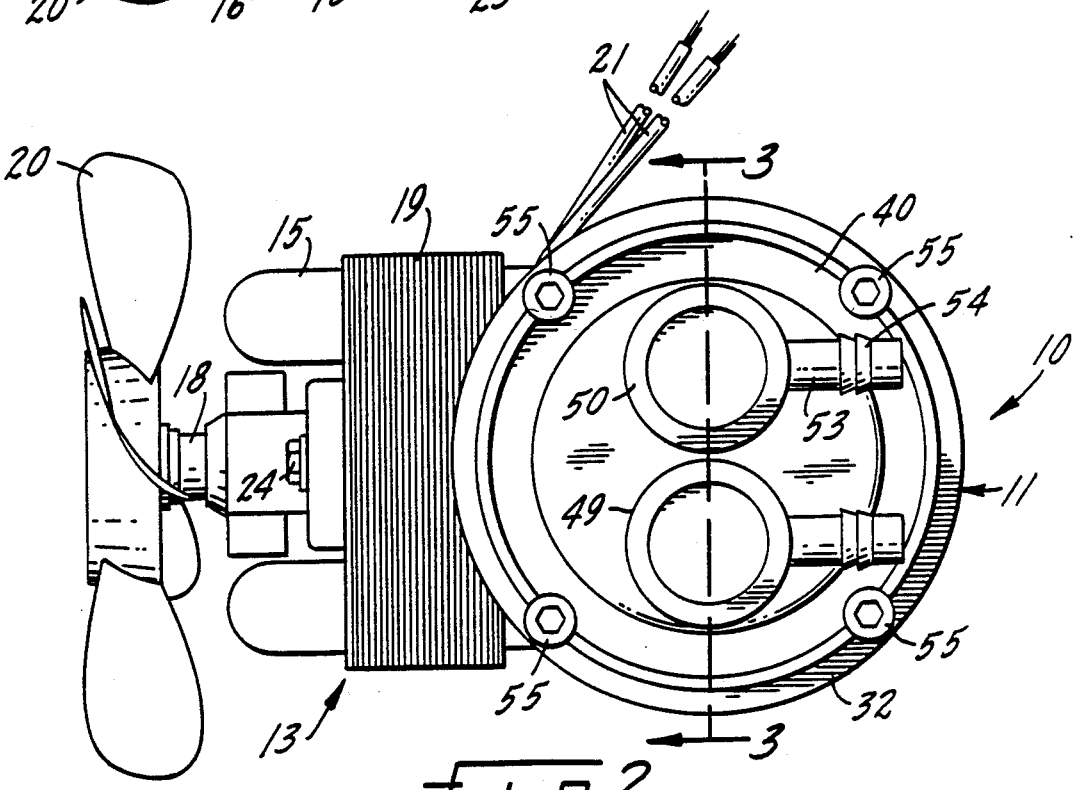
Fig. 2.

DIAPHRAGM COMPRESSOR

This is a continuation of application Ser. No. 004,899, filed Jan. 20, 1987, now abandoned.

This invention relates generally to fluid compressors and specifically to a diaphragm air compressor of the type usable with equipment such as aspirators and nebulizers.

BACKGROUND OF THE INVENTION

Diaphragm compressors of the general type illustrated in U.S. Pat. No. 4,275,999 are widely used in many industries. A typical example is the health industry where such compressors are used with aspirators and nebulizers in patient treatment, and these applications will be used as a frame of reference in describing the invention.

In the aspirator and nebulizer environment several factors in addition to the ability to achieve a stated pressure level are important. Prominent among these in the high volume health industry is cost. Such compressors of necessity require several working parts which must conform to rather precise tolerance limits and hence the cost of such compressors, particularly when they are employed in "single-use" applications, has traditionally been quite high. Significant typical cost components include screws and other connectors. The complexity of prior constructions has also resulted in significant assembly costs which again tends to increase the end cost of conventional compressors.

SUMMARY OF THE INVENTION

The invention comprises a non-metallic assembly of valve operating components for a diaphragm compressor, said components being formed from plastic materials and being exceedingly inexpensively assembled. Indeed, the use of connectors, such as screws is virtually eliminated.

Accordingly a primary object of the invention is to provide a diaphragm compressor which is particularly well adapted for use in environments which require reliable operation by an inexpensive assembly.

A more specific object is to provide a valve and a valve actuating sub-assembly for a diaghragm compressor which does not require screws or other connectors, nor expensive assembly procedures.

A further specific object is to provide a valve and valve actuating sub-assembly for a diaphragm compressor which can be constructed from plastic and rubber-like components and hence can be of such low cost that it may be economically discarded after a single patient use, or after only a minimum of uses.

Yet a further object is to provide a diaphragm compressor which includes a valve and valve actuating sub-assembly which is extremely simple in assembly and operation, utilizes press fitting in lieu of connectors, is reliable in operation and yet is sufficiently low in cost that it is economically feasible to employ the compressor in one-time use environments.

A further object is to provide a diaphragm compressor in which a separate valve plate, which is commonly used in this type of compressor is eliminated.

A further, object is to provide a diaghragm compressor as above described in which the inlet and outlet can be directed in any altitude.

Other objects and advantages of the invention will become apparent from a description of the following preferred embodiment.

BRIEF DESCRIPTION OF THE DRAWING

The invention is illustrated more or less diagrammatically in the accompanying drawing wherein:

FIG. 1 is a section view of the diaphragm compressor of this invention with known components in solid and others partially broken away for clarity;

FIG. 2 is a top plan view;

DESCRIPTION OF THE PREFERRED EMBODIMENT

Figure 3:
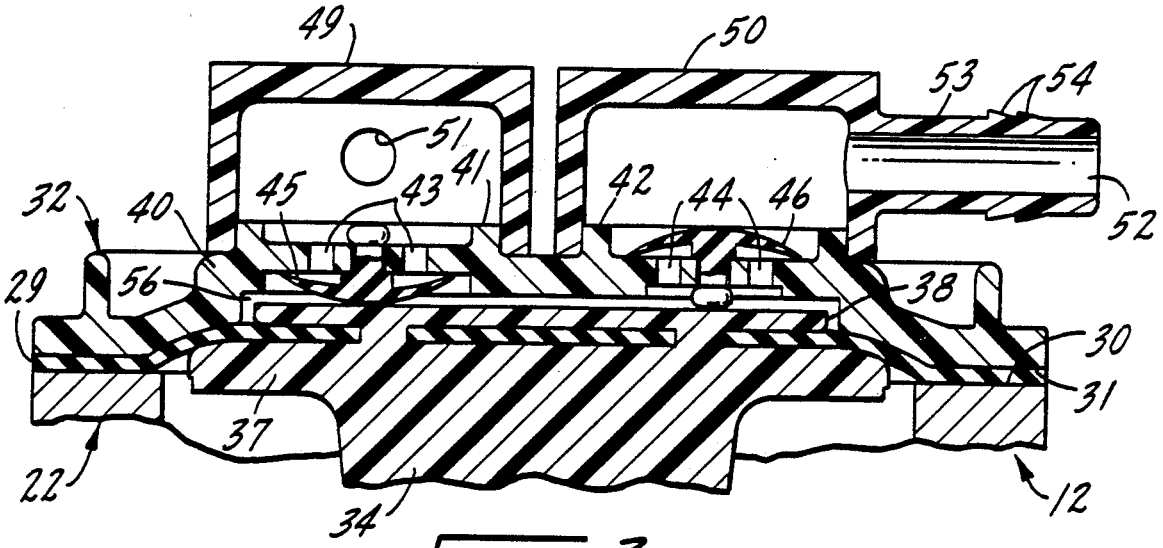
FIG. 3 is a sectional view, to an enlarged scale, taken illustrating a preferred mode of connecting a head cap to the head plate, the umbrella valves, and the diaphragm portion of the connecting rod assembly.
Figure 4:
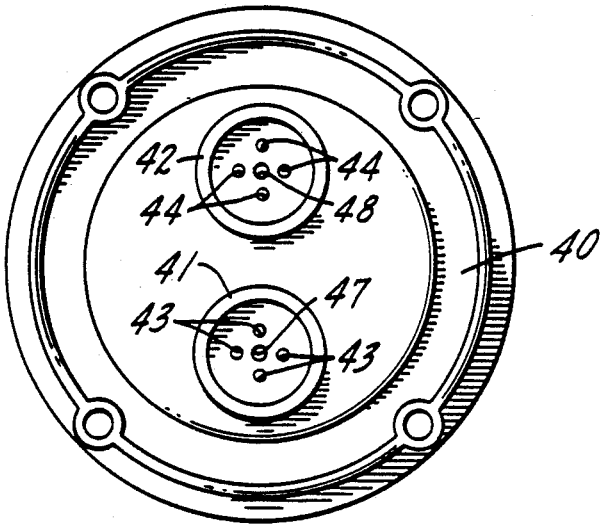
FIG. 4 is a top plan view of the head plate with parts omitted for clarity.

Like reference numerals will be used to refer to like parts throughout the following description of the preferred embodiment.

The diaphragm compressor, including its unique valve assembly, which comprises the invention is indicated generally at 10 in FIGS. 1 and 2. The compressor includes a diaphragm assembly indicated generally at 11, a diaphragm support assembly indicated generally at 12, and a power source indicated generally at 13.

The power source 13 includes a bearing bracket assembly 15, which may be mounted to any suitable base by fasteners received in threaded holes 16. The bearing bracket assembly carries spaced shaft bearing assemblies, one of which is shown at 17. A power shaft 18 driven by stator 19 imparts compression and exhaustion motion to a diaphragm in the diaphragm assembly as will appear hereinafter. The power shaft 18 also carries a fan 20 which forces cooling air through the bearings which support the power shaft 18. It will be assumed from FIG. 1 that the direction of air flow is from left to right. It will be noted however that the flow direction can be right to left if desired for a different application. Power leads are indicated at 21.

The diaphragm support assembly 12 includes a housing 22 which is secured, as by stator screws 23, 24, to the power source 13. The diaphragm support assembly 12 is here shown as an enclosed generally T-Shaped chamber of a size sufficient to receive the power take-off end 25 of power shaft 18 in its lower portion, and the diaphragm assembly 11 in its upper portion. A snap-in plug 26 provides easy access to the power shaft 18.

The diaphragm assembly 1 1 includes a connecting rod assembly, indicated generally at 28, which carries a flexible diaphragm 29. The flexible diaphragm is clamped between mating surfaces 30, 31 on the housing 22, and the head plate assembly 32 of the diaphragm assembly 11, respectively.

The connecting rod assembly 28 includes a generally vertical oriented rod section 34 which terminates, at its lower end, in a recess which carries a bearing 35. The bearing 35 receives an offset reduced diameter portion 36 of power shaft 18 so that rod section 34 moves up and down once per revolution of shaft 18.

Rod section 34 has a header section which includes a diaphragm support plate 37 and a hold down plate 38. The connecting rod section 34, diaphragm support plate 37, and hold down plate 38 are all composed of a plastic material which is compatible with respect to ultrasonic welding characteristics, from part to part, such as Rynite 530. As best seen in FIGS. 1 and 2, diaphragm 29 has openings formed therein in the area of overlap of hold down plate 38 and diaphragm support plate 37, and the plastic material fills the openings thereby integrally connecting the hold down plate 38 to the diaphragm support plate 37. Preferably the connection of the hold down plate 38 to the diaphragm support plate 37 is made by ultrasonic welding to provide the unitary 1-piece construction shown.

The head plate assembly 32 includes a head plate 40 having an inlet cap flange 41 and an outlet head cap flange 42. A plurality, in this instance, four, inlet passages are indicated at 43 within the area circumscribed by flange 41, and, similarly, four outlet passages are indicated at 44 within the area circumscribed by outlet flange 42. An inlet valve is indicated at 45 and an outlet valve at 46, each valve having a stem which is received, and held, in center passages 47, 48, of the flanges 41, 42 respectively. An inlet head cap is shown at 49 and an outlet head cap at 50, each of the head caps being snugly engaged, as by a press fit derived from a dimensional mis-match, with an associated flange 41 and 42 respectively. Alternatively the head caps 49, 50 may be ultrasonically welded to the flanges 41, 42. If preferred glue, solvent bonding, spin welding and equivalent means may be used. An inlet passage is indicated at 51 and an outlet passage at 52. Each of the inlet and outlet passages are formed into a tubingonnector, of which the outlet connector is indicated at 53. Tubing grippers are indicated at 54.

The head plate assembly 32 is secured to the housing 22 by any suitable means, such as head connectors 55 as seen in FIG. 2.

The use and operation of the invention is as follows:

Upon rotation of the power shaft 18, the rod section 34 of the connecting rod assembly 28 will move up and down once per shaft revolution due to the eccentricity of the axis of the axially offset reduced diameter portion 36 of the shaft 18 from the axis of shaft 18.

As the connecting rod 34 moves downward, fluid, such as air, will be sucked by an inlet passage 51 into the chamber within inlet head cap 49 and thence through inlet pasages 43 in head plate 40 because umbrella valve 45 will open due to the pressure differential across it, thereby permitting fluid flow in a downward direction as viewed in FIG. 3.

Fluid will continue to flow past umbrella valve 45 so long as connecting rod 34 moves downwardly carrying diaphragm 29 with it and increasing the size of the chamber 56 between the underside of head plate 40 and the top of hold down plate 38. Outlet valve 46 will of course remain closed during the downstroke of connecting rod 34.

Just after the maximum lower displacement of the axis of reduced diameter portion of 36 of shaft 18 is reached and said reduced diameter portion starts upwardly, umbrella valve 45 will close and, concurrently, umbrella valve 46 will open, during the upward or compression stroke of the cycle, the pressure in the chamber 56 will keep umbrellas valve 45 closed and umbrella valve 46 open so that the fluid in chamber 56 can be driven through outlet passages 44 into the chamber in outlet head cap 50, and to discharge through outlet passage 52 in outlet connector 53. If it is desired to remove the parts which come into contact with working fluid during use, such as after usage with a hospital patient, the head connectors 55 are loosened, the connecting rod assembly 28 slid off the reduced diameter portion 36 of the shaft 18, and discarded. Snap in plug 26 may be removed to assist in the removal of the connecting rod assembly if necessary. Thereafter a new connecting rod assembly 28 is put in place, the head connectors 55 re-tightened, and the tubing reconnected to the inlet connector and the outlet connector 53.

No leakage is possible because of the tight seal between the diaphragm 29 and the mating services on head plate 40 and housing 22.

Since the connecting rod section 34, diaphragm support plate 37 and hold down plate 38 are formed of a compatible plastic and are ultrasonically welded, the part component costs are low and the assembly costs are also low as contrasted to the use of mechanical connectors, such as screws. As a result the total cost of the unit can be brought so low that it is economically feasible to discard the connecting rod assembly, together with a diaphragm, and the head plate 40 and its associated components as well, after a single patient use. These are the only components as to which contamination is a concern since the air passage system is totally closed off from the power system and the diaphragm support assembly 12.

It will at once be apparent to those skilled in the art, that various modifications may be made within the spirit and scope of the invention. Accordingly, it is intended that the scope of the invention be limited solely by the scope of the hereinafter appended claims when interpreted in light of the relevant prior art.

We claim:

1. A single use valve and pumping chamber assembly for a diaphragm compressor, said single use valve and pumping chamber assembly including a single use flexible diaphragm, a single use connecting rod structure for actuating the flexible diaphragm by an eccentrically rotated compressor shaft, said connecting rod structure comprising a unitary plastic structure having means for receiving an eccentric portion of a rotating compressor shaft at the lower end portion thereof, and means for fixing the flexible diaphragm to the upper end portion thereby whereby as said unitary structure moves in generally upward and generally downward directions, it raises and lowers the flexible diaphragm, a unitary, one piece housing adapted to be air tightly secured to the flexible diaphragm to thereby form, with the flexible diaphragm, an expandable and collapsible pumping chamber, fastening means for securing the housing to the compressor, header means over the inlet passage in the housing and communicating with a source of inlet fluid, and over the outlet passage in the housing for exhausting fluid from the pumping chamber, an inlet passage and an outlet passage in said header means, inlet valve means in the inlet passage and outlet valve means in the outlet passage, an access port in said housing adjacent to the lower end of said connecting rod structure to facilitate removal of said connecting rod structure from the compressor shaft, and said diaphragm, connecting rod structure, housing, valve means and header means being removable and discardable as a unit with and from a driving compressor after a single use.

2. A single use valve and pumping chamber assembly in accordance with claim 1 wherein:

said connecting rod structure is supported at only two locations, a first support location being at said means for receiving an eccentric portion of a rotating compressor shaft, and a second support location being at a point of connection between said connecting rod structure and said diaphragm.

3. A single use valve and pumping chamber assembly in accordance with claim 1 whereby:

said inlet valve means and said outlet valve means are identical but oppositely oriented umbrella valves carried by said header means.

4. A single use valve and pumping chamber assembly in accordance with claim 1 wherein:

said connecting rod structure is comprised of two ultrasonically welded parts engaging said diaphragm whereby it is integrally connected thereto.

5. A single use valve and pumping chamber assembly for a diaphragm compressor, said single use valve and pumping chamber assembly including a single use flexible diaphragm, a single use connecting rod structure for actuating the flexible diaphragm by an eccentrically rotated compressor shaft, said connecting rod structure comprising a unitary plastic structure having means for receiving an eccentric portion of a rotating compressor shaft at the lower end portion thereof, and means for fixing the flexible diaphragm to the upper end portion thereby whereby as said unitary structure moves in generally upward and generally downward directions, it raises and lowers the flexible diaphragm, said connecting rod structure being supported at only two locations, support at its upper end being provided by connection between said diaphragm and said upper end portion, and support of its lower end being provided by connection to said compressor shaft, a unitary one piece housing adapted to be air tightly secured to the flexible diaphragm to thereby form, with the flexible diaphragm, an expandable and collapsible pumping chamber, fastening means for securing the housing to the compressor, an inlet passage and an outlet passage in said header means, header means over the inlet passage in the housing and communicating with a source of inlet fluid, and over the outlet passage in the housing for exhausting fluid from the pumping chamber, inlet valve means in the inlet passage and outlet valve means in the outlet passage, said diaphragm, connecting rod structure, housing, valve means and header means being removable and discardable as a unit with and from a driving compressor after a single use, and an access port in said housing adjacent to the lower end of said connecting rod structure to facilitate removal of said connecting rod structure from the compressor shaft.

* * * * *